US005506666A

United States Patent [19]

Masuda et al.

[11] Patent Number: 5,506,666

[45] Date of Patent: Apr. 9, 1996

[54] ELECTROPHOTOGRAPHIC PRINTING MACHINE HAVING A HEAT PROTECTING DEVICE FOR THE FUSER

[75] Inventors: Syuzou Masuda; Masato Ishii; Ryoichi Iwama, all of Kawasaki, Japan

[73] Assignee: Fujitsu Limited, Kawasaki, Japan

[21] Appl. No.: 289,531

[22] Filed: Aug. 12, 1994

[30] Foreign Application Priority Data

Sep. 1, 1993 [JP] Japan ..... 5-217609

[51] Int. Cl.[6] ..... G03G 15/20; G03G 21/00

[52] U.S. Cl. ..... 355/282; 347/156; 355/210

[58] Field of Search ..... 355/200, 210, 355/282, 285, 289, 211, 212; 347/152, 156

[56] References Cited

U.S. PATENT DOCUMENTS

| | | | |
|---|---|---|---|
| 3,574,455 | 4/1971 | Mix et al. | 355/211 |
| 4,610,526 | 9/1986 | Aser | 355/212 X |
| 4,639,749 | 1/1987 | Ito | 346/1 |
| 4,845,519 | 7/1989 | Fuse | 355/212 X |
| 5,196,870 | 3/1993 | Itoh et al. | 355/212 X |

*Primary Examiner*—Fred L. Braun

*Attorney, Agent, or Firm*—Armstrong, Westerman, Hattori, McLeland & Naughton

[57] ABSTRACT

An electrophotographic printing machine includes a transporting part for transporting a recording medium, and a carriage movable in a first direction transverse to a second direction in which the recording medium is transported. The carriage includes a process part for forming a latent image on an image carrier and forming a toner image of the latent image, and a fixing part for thermally fixing a transferred image corresponding to the toner image on the recording medium. A transfer part, which is provided at a first side of the recording medium opposite to a second side thereof at which the carriage is located, transfers the toner image on the recording medium to thereby form the transferred image. A refuge part in which the fixing part can take refuge is located at a side of the transfer part and located in a print starting position in which the fixing part provided in the carriage is located so as to prevent the transfer part from being thermally affected by the fixing part.

25 Claims, 13 Drawing Sheets

ELECTROPHOTOGRAPHIC PRINTING MACHINE HAVING A HEAT PROTECTING DEVICE FOR THE FUSER

BACKGROUND OF THE INVENTION

1. Field of the Invention

The present invention generally relates to electrophotographic printing machines, and more particularly to an electrophotographic printing machine equipped with an image fixing device provided in a carriage performing printing.

Recently, electrophotographic printing machines having a carriage operating in an electrophotographic process have been developed due to demands for cost reduction and down-sizing of electrophotographic recording machines. Generally, such electrophotographic printing machines operate so that a carriage is moved on a transfer device in the direction traverse (perpendicular) to the direction in which paper is transported, and an image transferred on the paper is fixed by means of a roller-shaped fixing device disposed in the paper transporting direction. In order to facilitate down-sizing, an electrophotographic printing machine has been developed in which the fixing device is provided in the carriage. Nowadays, it is required that such an electrophotographic printing machine operates safely and the size thereof is further reduced.

2. Description of the Prior Art

FIGS. 1A, 1B and 1C show the structure of a carriage provided in a conventional electrophotographic printing machine. More particularly, FIG. 1A is a plan view of the carriage and its peripheral parts, FIG. 1B is a cross-sectional view taken along a line $I_B$—$I_B$ shown in FIG. 1A, and FIG. 1C is a cross-sectional view taken along a line $I_C$—$I_C$ shown in FIG. 1A.

Referring to FIGS. 1A through 1C, a carriage 11 is made up of a process unit 12 and a fixing device 13, and is moved, by means of a driving motor (not shown for the sake of simplicity) above a transfer unit (print platen) 15 along guides 14*a* and 14*b* in the direction traverse to the paper transporting direction. On the either side of the carriage 11, transporting rollers 16*a* and 16*b* are arranged. A recording paper 17 is transported between the transfer unit 15 and the carriage 11 by means of the transporting rollers 16*a* and 16*b*.

The process unit 12 of the carriage 11 is equipped with an image carrier 21, which is rotated at a circumferential speed synchronized with the movement of the carriage 11. The surface of the image carrier 21 is uniformly electrified by a charger 22. An electrostatic latent image is formed on the surface of the image carrier 21 by an exposure unit 23. The electrostatic image is visualized as a toner image by means of a developing roller 24. The toner image is transferred onto the recording paper 17 by means of the transfer unit 15 located at the side of the recording paper 17 opposite to the image carrier 21. The toner particles remaining on the image carrier 21 are scraped away by a cleaner 25.

The surface of the image carrier 21 which has been cleaned in the above way is electrified again by the charger 22, and the same process as described above is repeatedly performed. When the printing along a predetermined width is completed, the recording paper 17 is transported by a predetermined amount of movement by means of the transporting rollers 16*a* and 16*b*. The carriage 11 is returned to the predetermined position (home position), and performs the printing again. The home position is defined as a position which is located above the transfer unit 15 but is not located above the recording paper 17.

The image transferring by the transfer unit 15 is performed by applying a voltage to the transfer unit 15, an electrically conductive member 15*b* such as an electrically conductive rubber sheet is placed on a base 15*a*.

The fixing unit 13 is equipped with a fixing roller 26 in which a heat source 27 such as a halogen lamp is provided. The fixing roller 26 is preheated to a predetermined temperature by the heat source 27 before starting the printing operation. The temperature measured during printing is sensed by means of a temperature detector such as a thermistor (not shown for the sake of simplicity), and the fixing roller 26 is controlled based on the sensed temperature. That is, the fixing unit 13 is moved together with the process unit 12, and performs the fixing operation immediately after the image transfer by the process unit 12.

FIG. 2 is a diagram of another conventional carriage. In FIG. 2, parts that are the same as those shown in the previously described figures are given the same reference numerals. A halogen lamp (infrared lamp) 28 is provided, as a heat source, in the fixing unit 13 of the carriage 11. Further, a mirror 29 is provided in the periphery of the halogen lamp 28. The fixing unit 13 directly applies heat to the recording paper 17 in order to fix the image transferred to the recording paper 17 thereto.

However, the conventional carriages 11 shown in FIGS. 1A through 1C and FIG. 2 have the following disadvantages. After images are recorded on the recording paper 17, the carriage 11 is returned to the home position. That is, the carriage 11 waits for the starting of the next printing process at the position outside of the recording paper 17. In this state, the fixing roller 26 shown in FIGS. 1A and 1B is in direct contact with the electrically conductive member 15*b* of the transfer unit 15, and the halogen lamp 28 shown in FIG. 2 directly projects heat on the electrically conductive member 15*b*. Hence, there is a possibility that the electrically conductive member 15*b* may be damaged. Further, the long preheating time is needed to heat the fixing roller 26 to the predetermined temperature because heat is radiated from the fixing roller 26 via the transfer unit 15.

The fixing unit 13 shown in FIGS. 1A and 1B needs the halogen lamp 27 of a large size. Hence, the size of the fixing roller 26 is large. Further, the temperature distribution along the axis of the fixing roller 26 may be uneven due to the filament density of the halogen lamp 27.

Further, in the direct heat projecting by the halogen lamp 28 shown in FIG. 2, the energy density of the halogen lamp 28 is low and the rate of fixing toner images to recording paper is low due to the non-contact fixing process. Hence, it takes a long time to complete the fixing process.

As a disadvantage common to the carriages 11 shown in FIGS. 1A through 1C and FIG. 2, there is a possibility that the temperature of the carriages 11 may be increased to an abnormal value due to a fault of the temperature detector or the like if the carriage 11 stops operating due to a jam occurring in the printing process.

SUMMARY OF THE INVENTION

It is a general objects of the present invention to provide an electrophotographic printing machine in which the above disadvantages are eliminated.

A more specific object of the present invention is to provide a down-sized electrophotographic printing machine capable of performing the print starting operation and the fixing process in shorter times.

The above objects of the present invention are achieved by an electrophotographic printing machine comprising:

transporting means for transporting a recording medium;

a carriage movable in a first direction transverse to a second direction in which the recording medium is transported, the carriage comprising process means for forming a latent image on an image carrier and forming a toner image of the latent image, and fixing means for thermally fixing a transferred image corresponding to the toner image on the recording medium;

transfer means, provided at a first side of the recording medium opposite to a second side thereof at which the carriage is located, for transferring the toner image on the recording medium to thereby form the transferred image; and a refuge part located at a side of the transfer means and located in a print starting position in which the fixing means provided in the carriage takes refuge so as to prevent the transfer means from being thermally affected by the fixing means.

The above objects of the present invention are also achieved by an electrophotographic printing machine comprising:

transporting means for transporting a recording medium;

a carriage movable in a first direction transverse to a second direction in which the recording medium is transported, the carriage comprising process means for forming a latent image on an image carrier and forming a toner image of the latent image, and fixing means having a fixing member for thermally fixing a transferred image corresponding to the toner image on the recording medium;

transfer means, provided at a first side of the recording medium opposite to a second side thereof at which the carriage is located, for transferring the toner image on the recording medium to thereby form the transferred image;

a refuge part located at a side of the transfer means and located in a print starting position in which the fixing means provided in the carriage takes refuge so as to prevent the transfer means from being thermally affected by the fixing means; and first heating means for heating the fixing member of the fixing means when the carriage is located in the print starting position.

BRIEF DESCRIPTION OF THE DRAWINGS

Other objects, features and advantages of the present invention will become more apparent from the following detailed description when read in conjunction with the accompanying drawings, in which.

DESCRIPTION OF THE PREFERRED EMBODIMENTS

Figure 1A:
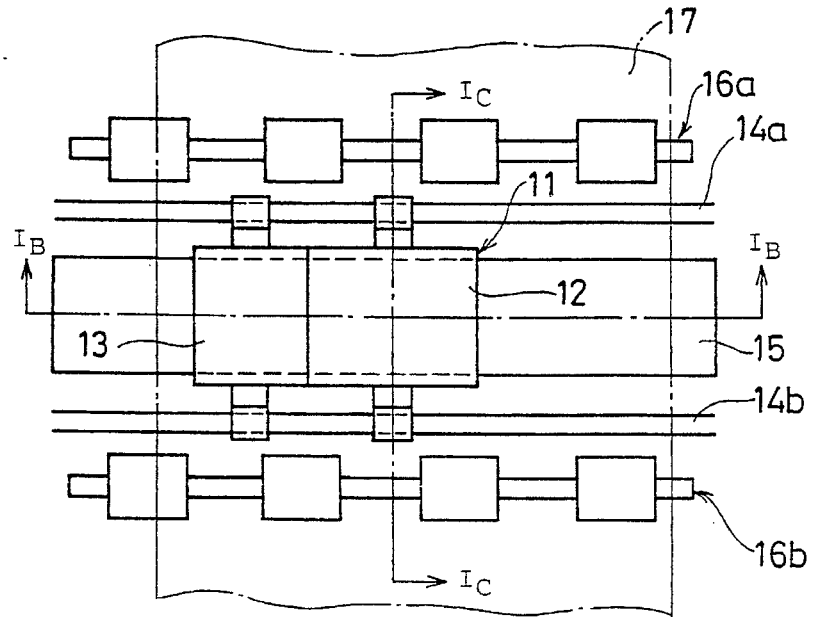
FIG. 1A PRIOR ART
FIG. 1A is a plan view of a carriage of a conventional electrophotographic printing machine.
Figure 1B:
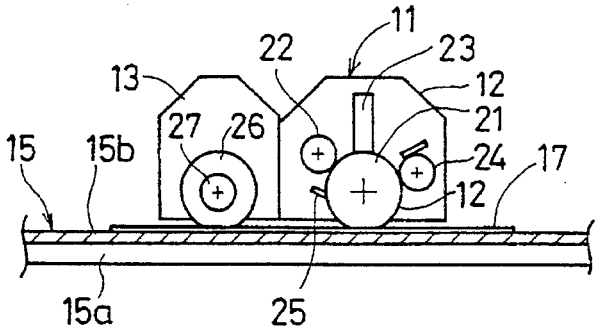
FIG. 1B PRIOR ART
FIG. 1B is a cross-sectional view taken along a line $I_B$—$I_B$ shown in FIG. 1A.
Figure 1C:
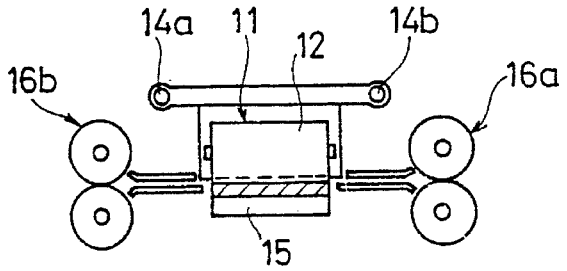
FIG. 1C PRIOR ART
FIG. 1C is a cross-sectional view taken along a line $I_C$—$I_C$ shown in FIG. 1A.
Figure 2:
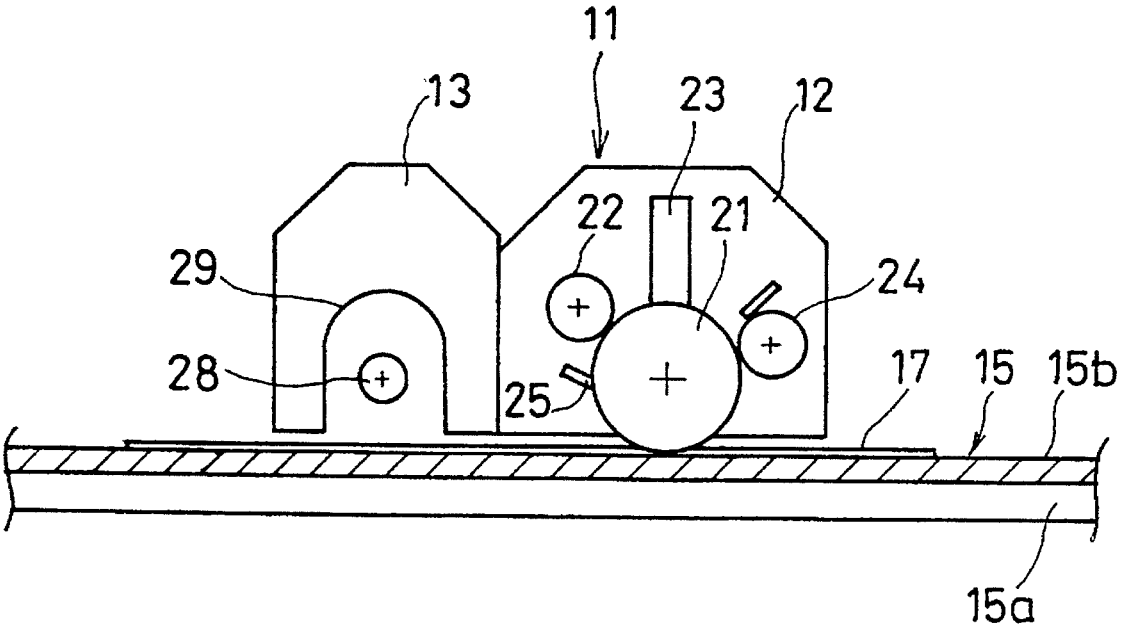
FIG. 2 PRIOR ART
FIG. 2 is a cross-sectional view of another conventional carriage.
Figure 3A:
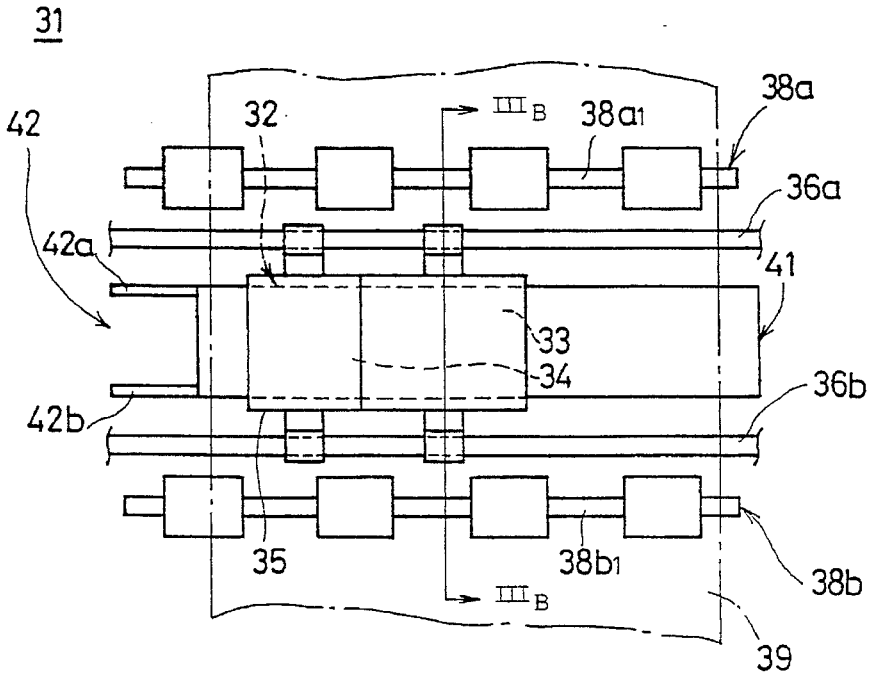
FIG. 3A is a plan view of a first embodiment of the present invention.
Figure 3B:
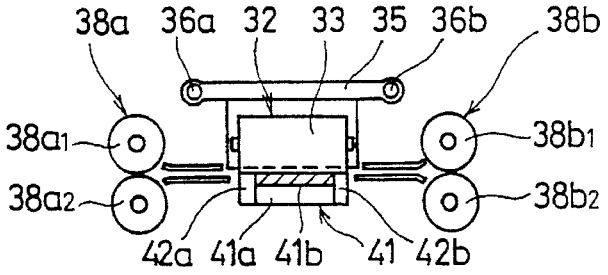
FIG. 3B is a cross-sectional view taken along a line $III_B$—$III_B$ shown in FIG. 3A.
Figure 3C:
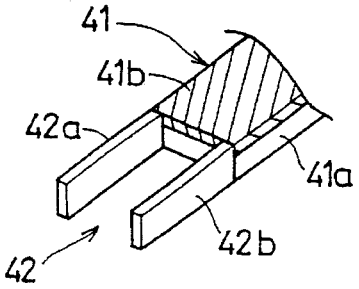
FIG. 3C is a perspective view of a refuge part shown in FIG. 3A.
Figure 3D:
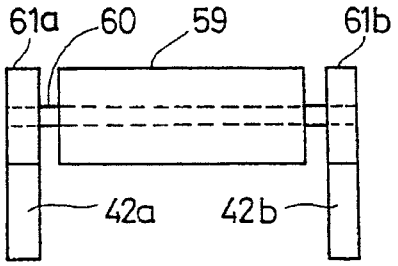
FIG. 3D is a schematic front view of the refuge part.
Figure 4:
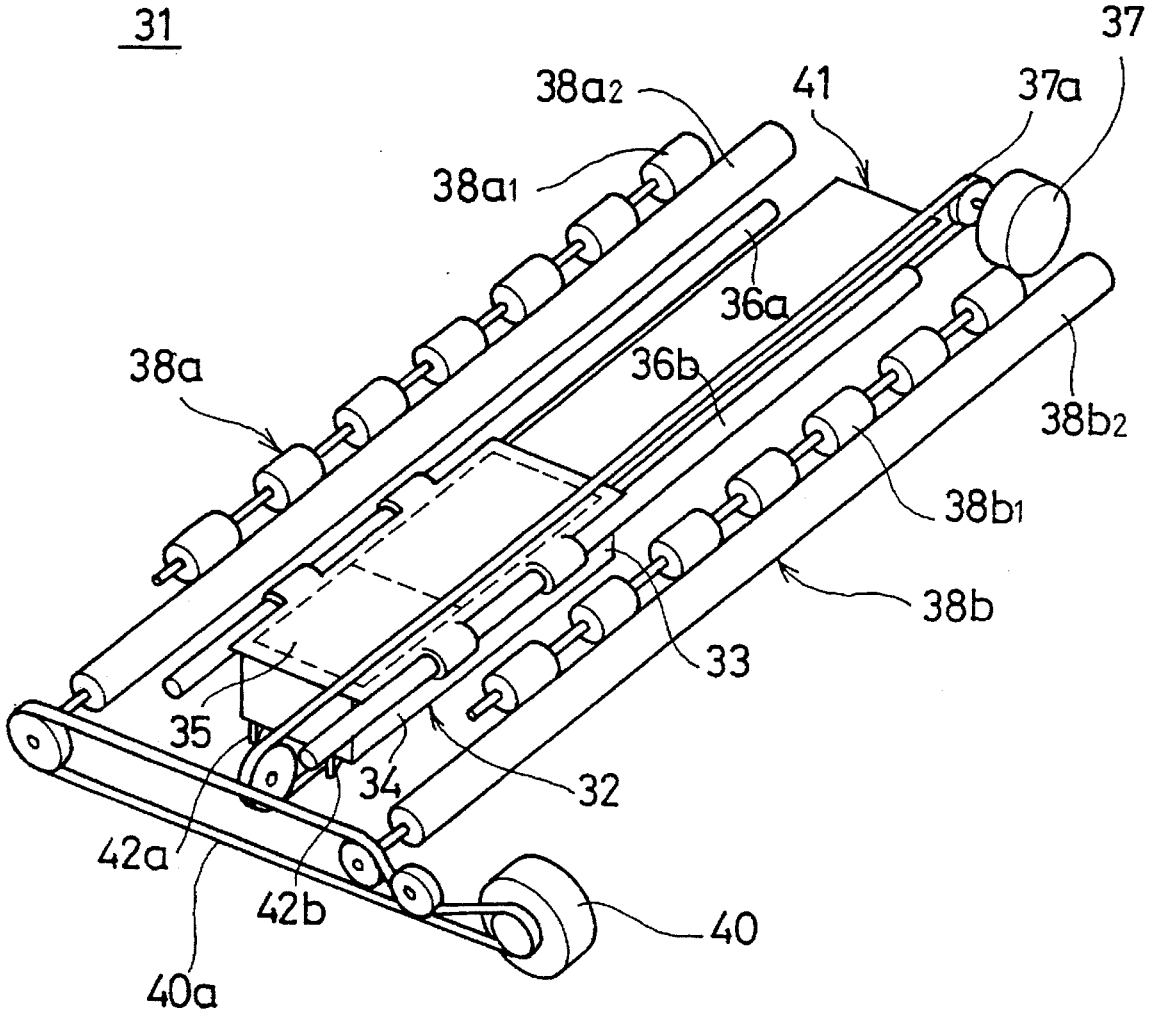
FIG. 4 is a perspective view of the first embodiment of the present invention.

A description will now be given, FIGS. 3A, 3B, 3C and 3D and FIG. 4, of a first embodiment of the present invention. FIG. 3A is a plan view of a carriage and its peripheral parts of an electrophotographic printing machine, and FIG. 3B is a cross-sectional view taken along a line $III_B$—$III_B$ shown in FIG. 3A. FIG. 3C is a perspective view of a refuge part of a transfer unit, and FIG. 3D is a schematic front view of the refuge part. Further, FIG. 4 is a schematically perspective view of the structure of the overall electrostatic printing machine.

Referring to FIGS. 3A through 3D, an electrophotographic printing machine 31 includes a carriage 32, which is made up of a process unit 33 and a fixing unit 34, which units are attached to holding members 35. The holding members 35 are guided by shafts 36*a* and 36*b* and are moved in the direction transverse to the paper transporting direction by means of a driving motor 37 (FIG. 4) via a belt 37*a* (FIG. 4). In FIGS. 3A through 3D, the driving motor 37 and the belt 37*a* are omitted for the sake of simplicity.

A transporting roller assembly 38*a* is provided on one side of the shift 36*a*, and a transporting roller assembly 38*b* is provided on one side of the shaft 36*b*. The axes of the transporting roller assemblies 38*a* and 38*b* are parallel to the axes of the shifts 36*a* and 36*b*. The transporting roller assembly 38*a* includes a plurality of pairs of transporting rollers $38a_1$ and $38a_2$ between which rollers a recording paper 39 is transported. Similarly, the transporting roller assembly 38*b* includes a plurality of pairs of transporting rollers $38b_1$ and $38b_2$ between which rollers the recording paper 39 is transported. The transporting roller assemblies 38*a* and 38*b* are driven by a transporting motor 40 via a belt 40*a*.

A transfer unit 41 is disposed below the carriage 32. The transfer unit 41 has a base 41*a* made of aluminum or the like, and a heat-resistant electrically conductive member 41*b* formed on the base 41*a*. The member 41 is, for example, a silicon rubber sheet containing an electrically conductive member. The recording paper 39 is positioned between the transfer unit 41 and the carriage 32. As shown in FIG. 3C, a refuge part 42 including two opposing heat-resistant members 42*a* and 42*b* is located at a position where the fixing unit 34 is located when the carriage 32 is at the home position (a latent image carrier which will be described later is positioned outside of the recording paper 39. The above position at which the refuge part 42 is positioned is also an end of the transfer unit 41.

For example, as shown in FIG. 3D, bearings 61*a* and 61*b* provided on either side of a rotary shaft 60 of a fixing roller 59 of the fixing unit 34 are positioned above the heat-resistant members 42*a* and 42*b* of the refuge part 42, so that the fixing roller 59 is not made to come into contact with anything. This will be described in more detail later.

FIG. 4 is a diagram of the carriage 32 shown in FIGS. 3A and 3B. As has been described previously, the carriage 32 is made up of the process unit 33 and the fixing unit 34. The process unit 33 is equipped with a recording drum 51 having a rotary axis 51*a* parallel to the direction of feeding the recording paper 39. The recording drum 51 functions as an image carrier. The recording drum 51 is rotated on the recording paper 39 located above the transfer unit 41 at a circumferential speed synchronized with the movement of the carriage 32.

An electrostatic latent image is formed, by means of an exposure unit 53, on the surface of the recording drum 51 which has been uniformly electrified by a charger 52. The electrostatic latent image is visualized as a toner image by applying toner particles 55 provided in a developing unit 54 and supplied by a developing roller 56 thereof to the surface of the recording drum 51. The toner image formed on the recording drum 51 is transferred onto the recording paper 39 by applying a predetermined voltage across the recording drum 51 and the transfer unit 41 opposite to the recording drum 51 via the recording paper 39.

After the image is transferred, the recording drum 51 is discharged by a discharging unit 57, and the toner particles 55 remaining on the recording drum 51 are scraped away by a cleaner 58.

The fixing unit 34 includes the fixing roller 59 having a cylinder made of a magnetic material and coated with Teflon. As shown in FIG. 3D, the bearings 61*a* and 61 are provided on the two ends of the rotary shaft 60 of the fixing roller 59. The fixing roller 59, the recording drum 51 and the developing roller 56 are rotated in synchronism with the movement of the carriage 32 by means of respective process motors (not shown for the sake of simplicity) provided inside and/or outside of the carriage 32.

The fixing roller 59 is equipped with a coating device 62 which coats a silicon oil facilitating detachment of the recording roller 59 from the recording paper 39. In the vicinity of the fixing roller 59, a heating unit 63 (which will be described later with reference to FIGS. 6 through 10), and a temperature sensor such as a thermistor 64 sensing the temperature of the fixing roller 59 are provided. The heating unit 63 is driven by an inverter 65, which is controlled by a main control circuit 66 on the basis of the sense signal from the thermistor 64. The inverter 65 and the main control circuit 66 are connected to a power supply 67, and the main control circuit 66 receives given signals from the process unit 33.

More particularly, the temperature of the fixing roller 59 is sensed by the thermistor 64. When the main control circuit 66 determines that the fixing roller 59 has risen to a predetermined temperature, the main control circuit 66 stops heating. When the main control circuit determines that the fixing roller 59 has fallen to another predetermined temperature, the main control circuit 66 starts to heat the fixing roller 59 again. In this manner, the above ON and OFF operations are repeatedly performed. Instead of the above two-stage ON/OFF control, it is also possible to employ another heating control in which the temperature of the fixing roller 59 is regulated stepwise. For example, the fixing roller 59 is set to a heating mode, a temperature maintaining mode or a cooling mode.

Figure 6A:
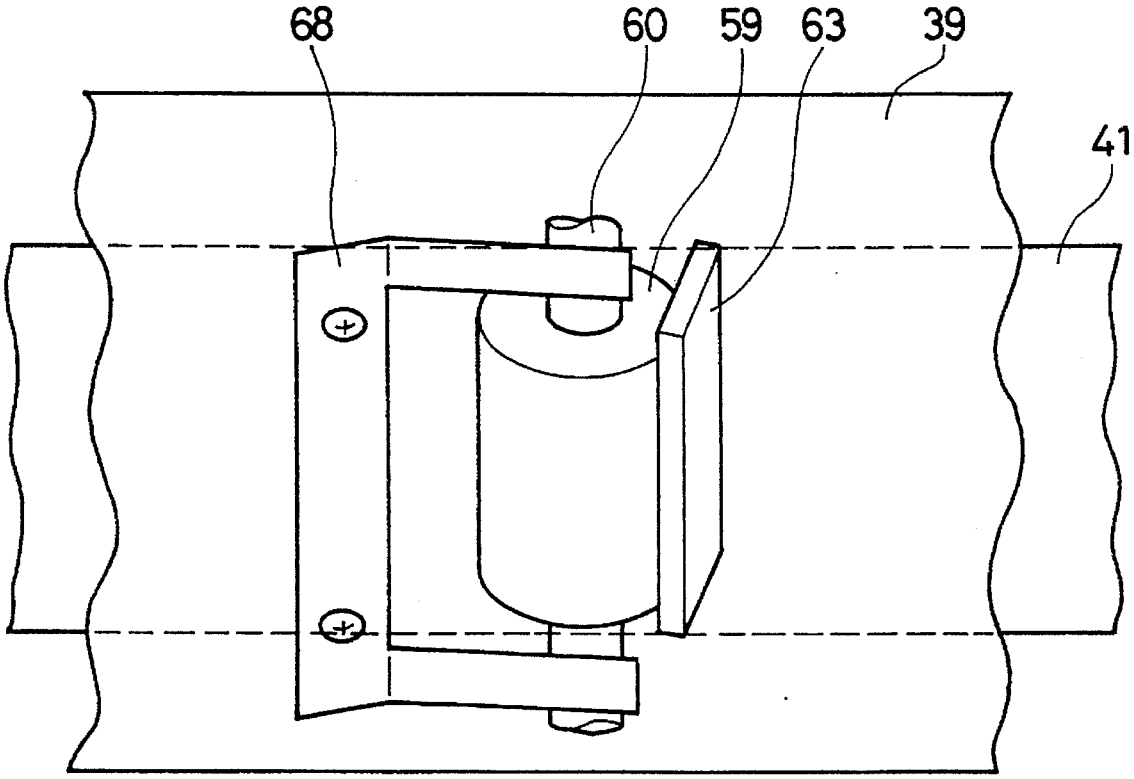
FIG. 6A is a perspective view of a fixing roller used in the first embodiment of the present invention.
Figure 6B:
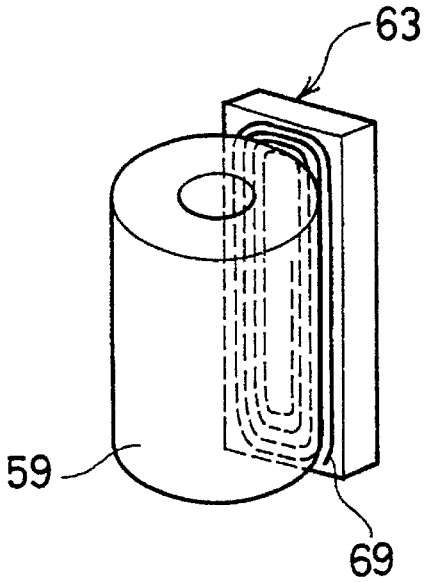
FIG. 6B is a perspective view of the fixing roller used in the first embodiment of the present invention.

FIGS. 6A and 6B shows how the fixing roller 59 is heated. As shown in these figures, the heating unit 63 is disposed in the vicinity of the fixing roller 59, and heats the fixing roller 59 in the state in which the heating unit 63 is in non-contact with the fixing roller 59. In order to improve the fixing performance, the rotary shaft 60 is urged toward the recording paper 39 by a pressure applying spring 68. The heating unit 63 includes an induction heating coil 69 wound so as to have a flat shape.

Figure 7A:
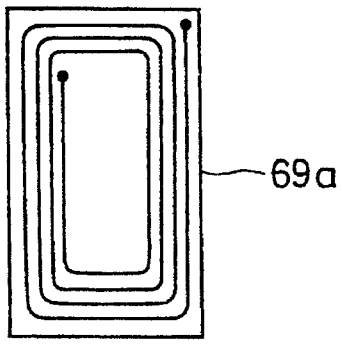
FIG. 7A is a diagram of a first example of an induction heating coil.
Figure 7B:
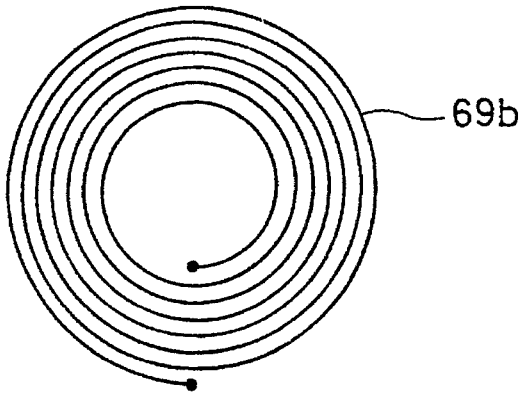
FIG. 7B is a diagram of a second example of the induction heating coil.
Figure 7C:
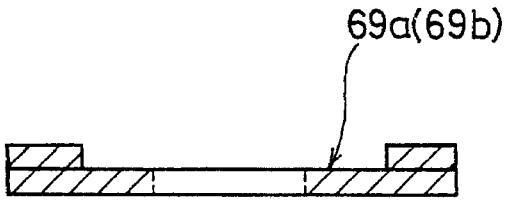
FIG. 7C is a diagram of a coil assembly composed of a plurality of induction heating coils such as the coils shown in FIGS. 7A and 7B.

FIGS. 7A, 7B and 7C shows examples of the induction heating coil 69. FIG. 7A shows an induction heating coil 69*a* formed by spirally winding a wire in a rectangular form. FIG. 7B shows an induction heating coil 69*b* formed by spirally winding a wire in a circular form. The induction heating coils 69*a* and 69*b* have respective spaces located in the centers thereof so as to be formed in a ring shape. As shown in FIG. 7C, the induction heating coils 69*a* and 69*b* are stacked stepwise so that the steps extend outward from the center portion of the coil assembly and match the shape of the fixing roller 59. It is preferable to stack the coils so as to have at least two steps. The above stacking formation contributes to applying an even magnetic flux distribution to the fixing roller 59 to thereby heat the fixing roller 59 efficiently and to efficiently radiating the heat of the coils 69*a* and 69*b*.

Figure 8A:
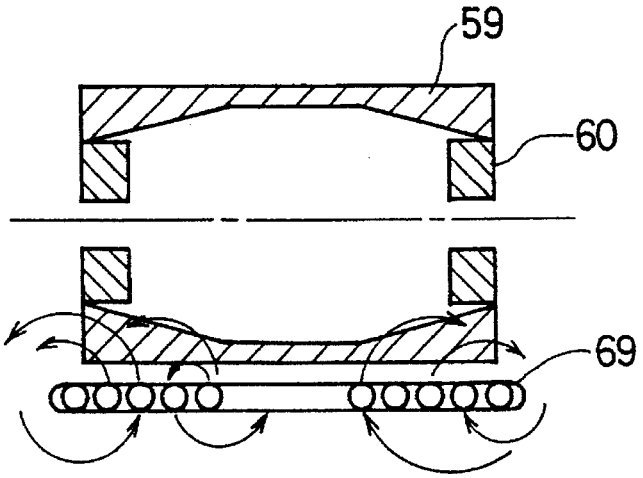
FIG. 8A is a diagram of the principle of heating by means of the induction heating coil.
Figure 8B:
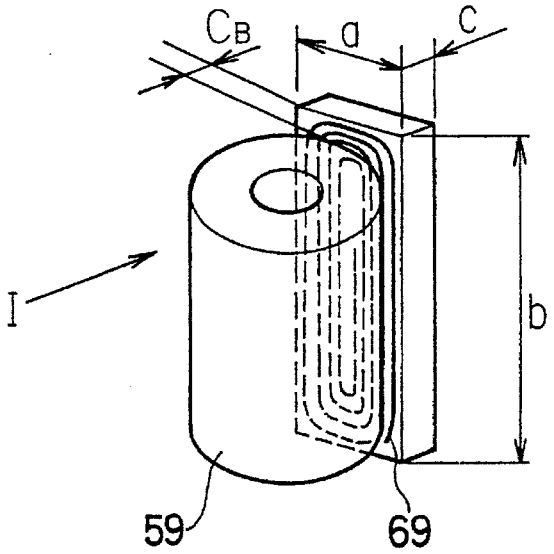
FIG. 8B is a diagram of the principle of the heating by means of the induction heating coil.

FIGS. 8A and 8B show the principle of heating. As shown in FIG. 8A, the fixing roller 59 is formed of a magnetic material and hence an eddy current is generated in the fixing roller 59 due to a variation in the magnetic flux (indicated by arrows) generated by a current flowing in the induction heating coil 69. The eddy current generates Joule heat in the fixing roller 59, which is thus heated.

In order to cause the induction heating to take place efficiently, as shown in FIG. 8B, it is preferable that the length b of the induction heating coil 69 be approximately equal to the length of the fixing roller 59 measured in the axial direction and that $c \ll a$ and $c \ll b$ where a denotes the width of the induction heating coil 69 and c denotes the depth thereof.

The magnetic field H generated by the induction heating coil 69 is proportional to the current I flowing in the induction heating coil 69 and is inversely proportional to CB, as shown below:

$$H=K(1/C_B) \quad (1)$$

where $C_B$ is the distance between the fixing roller 59 and the induction heating coil 69, and K is a constant dependent on the number of turns of the coil 69 and other factors.

The heating efficiency is improved as the constant $C_B$ becomes closer to zero. However, there is a case where the temperature of the induction heating coil 69 exceeds a tolerable level due to the heat generated in the fixing roller 59. For example, the toner generally used in the electrophotographic printing system needs a fixing temperature of 180° C., and the coils used generally needs a maximum tolerable temperature of 130° C. in the B type (a heat-resilient coil having a temperature tolerance of 150° C.) and a temperature of 150° C. in the F type (a heat-resilient coil having a temperature tolerance of 150° C.). Hence, it is necessary to provide a spacing to some extent in order to suppress an increase in the temperature of the induction heating coil 69. It is desirable that $C_B$ be between 3 mm and 4 mm. In this range, it becomes possible to perform efficient heating while suppressing an increase in the temperature of the induction heating coil 69.

It is possible to arbitrarily determine the temperature distribution in the axial direction of the fixing roller 59 by selecting the number of turns of the induction heating coils 69. Thereby, it becomes possible to obtain the uniform temperature distribution in the axial direction of the fixing roller 59 and improve the fixing performance.

Further, since the induction heating coil 69 is spaced apart from the fixing roller 59 by a predetermined distance, the temperature of the induction heating coil 69 is not affected by the heat generated in the fixing roller 59 and does not exceed the tolerable level thereof. Further, since the fixing roller 59 is heated by the induction heating process, the heating can be efficiently carried out and a high energy density can be obtained. Furthermore, the fixing roller can be rapidly increased to the target temperature even when it is heated from the ordinary temperature, so that the time necessary to start printing can be reduced.

Figure 9A:
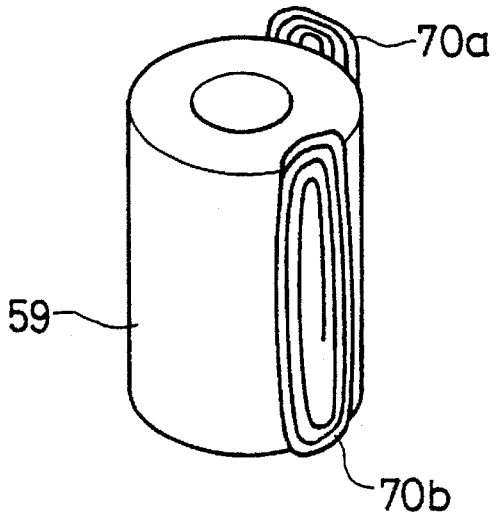
FIGS. 9A and 9B are diagrams of another structure of the induction heating coil.
Figure 9B:
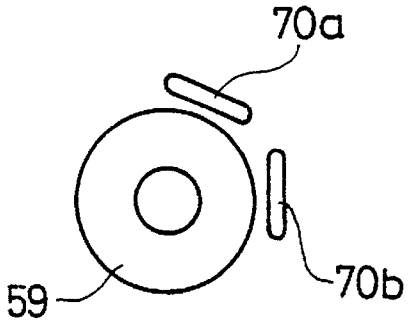

FIGS. 9A and 9B show another structure of the heating unit. The heating unit shown in FIGS. 9A and 9B has two induction heating coils 70*a* and 70*b* provided for the fixing roller 59. It is possible to arrange more than two induction heating coils with respect to the fixing roller 59. With the structure shown in FIGS. 9A and 9B, it is possible to efficiently utilize the magnetic fluxes generated by the induction heating coils 70*a* and 70*b*.

Figure 10A:
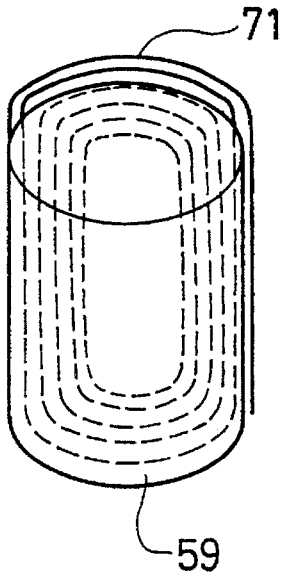
FIGS. 10A and 10B are diagrams of yet another structure of the induction heating coil.
Figure 10B:
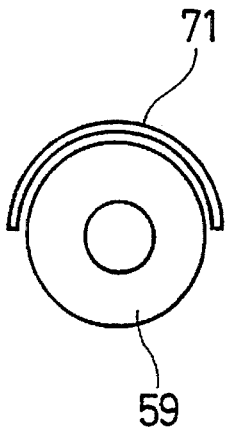

FIGS. 10A and 10B show yet another structure of the heating unit. The heating unit shown in these figures has an arch-shaped induction heating coil 71 arranged along the circular direction of the fixing roller 59. With the structure shown in FIGS. 10A and 10B, it is also possible to efficiently utilize the magnetic flux generated by the induction heating coil 71.

The shapes and arrangements of the windings of the induction heating coils 70*a*, 70*b* and 71 shown in FIGS. 9A, 9B, 10A and 10B are the same as those shown in FIGS. 7A, 7B, 7C, 8A and 8B.

Figure 5:
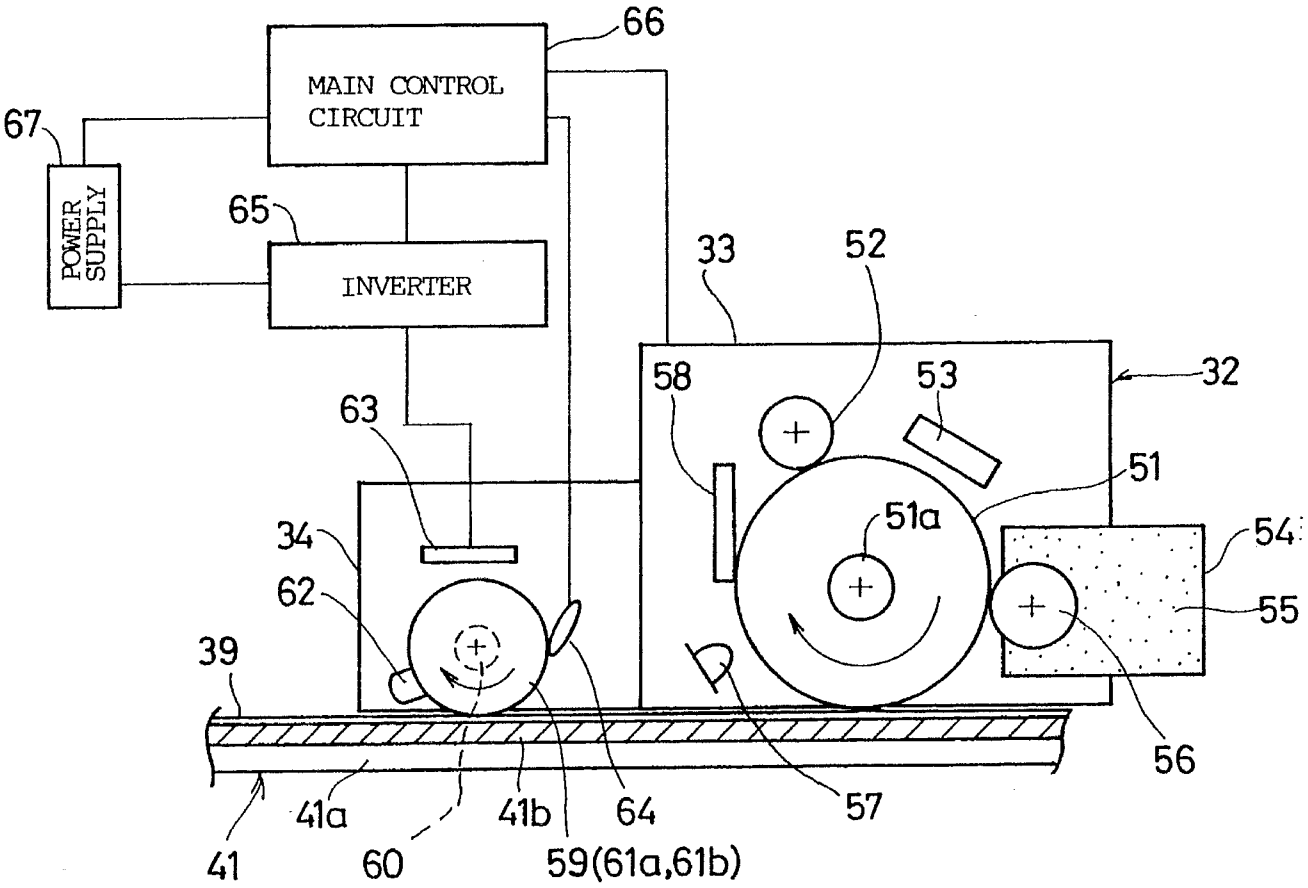
FIG. 5 is a diagram of the structure of a carriage shown in FIG. 3A.
Figure 11A:
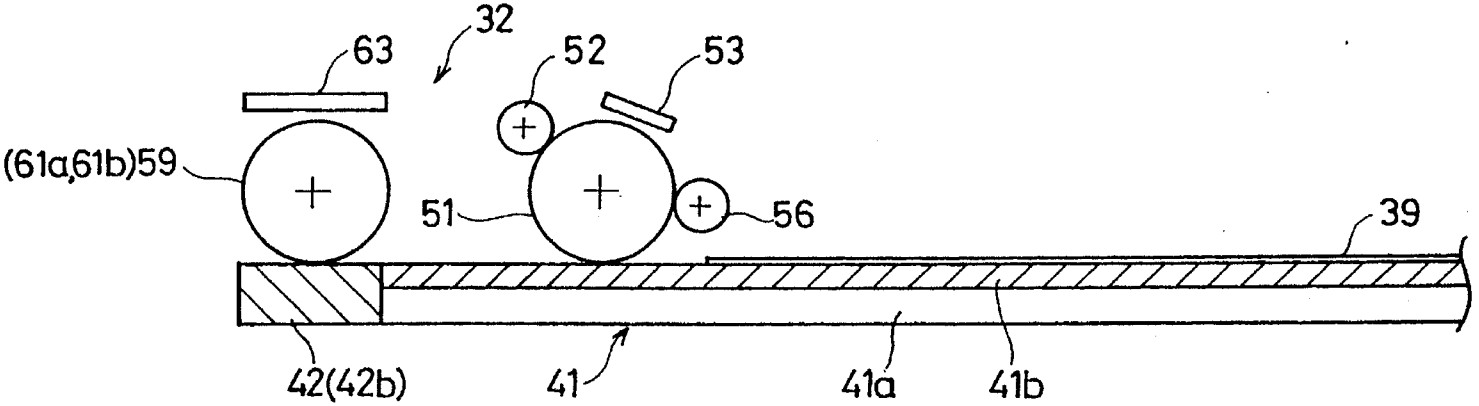
FIGS. 11A and 11B are diagrams showing the operation of the carriage.
Figure 11B:
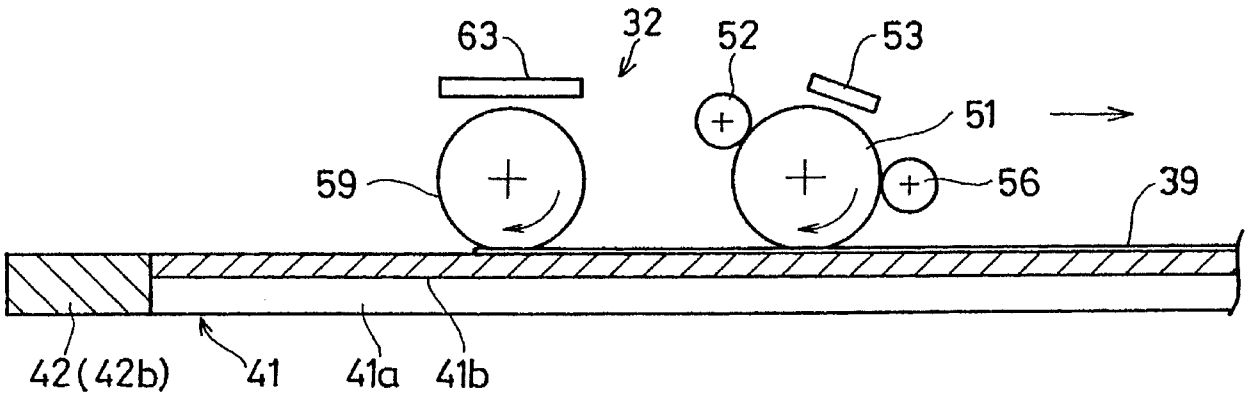

A description will now be given, with reference to FIGS. 11A and 11B in addition to FIG. 5, of the operation of the carriage 32. FIGS. 11A and 11B show a part of the process unit 33 and a part of the fixing unit 34. More particularly, FIG. 11A shows the carriage 32 located in the home position, which is defined as including the print starting position and a position to which the carriage 32 is returned each time printing of one line is completed.

In the state shown in FIG. 11A, the recording drum 51 is located out of the width of the recording paper 39 and the fixing roller 59 (the bearings 61*a* and 61*b*) are located on the refuge part 42. That is, the fixing roller 59 does not overlap the transfer unit 41. At this time, when the printing is started, the fixing roller 59 is heated to approximately 180° C. by the Joule heat generated due to a variation in the magnetic flux produced by the induction heating coil 69 of the heating unit 63. During the heating process, the induction heating coil 69 is driven by the inverter 65 and the main control circuit 66 performs the temperature control on the basis of the temperature sensed by the thermistor 64, as has been described previously. As shown in FIG. 5, the main control circuit 66 receives a signal (for example, a rotation signal of the recording drum 51 or the like), and determines, on the basis of the position of the recording drum 51 indicated by the received signal, whether or not the fixing roller 59 should be heated.

After the printing is started, as shown in FIG. 11B, the carriage 32 is moved by the carrier motor 37 in the direction transverse to the transporting direction of the recording paper 39, and the recording drum 51 and the fixing roller 59 are simultaneously rotated at a speed relative to the recording paper 39. The visible image (toner image) formed on the recording drum 51 by the exposure unit 53 and the developing roller 56 is transferred onto the recording paper 39 by the transfer unit 41. Immediately after the above, the transferred image is fixed on the recording paper 39 by the fixing roller 59.

The carriage 32 is returned to the home position shown in FIG. 11A each time one line is processed. The temperature of the fixing roller 59 is controlled by the heating unit 63 within a small temperature range until the printing is completed.

In the above-mentioned way, the heating and fixing is performed for a short time by the fixing unit 34, which is moved in cooperation with or in synchronism with the process unit 33. In this operation, the heat-resistant member 41*b* of the transfer unit 41 is not damaged due to the heat of the fixing unit 34. Since the transfer unit 41 is equipped with the refuge part 42 comprising a heat-resistant member, it becomes possible to prevent thermal diffusion at the time of heating the fixing roller 59 before printing and a change of the nature of the refuge part 42 due to the heat can be prevented. Since the fixing roller 59 is heated by the induction heating process, the fixing roller 59 can be of a small-size and has a small thermal capacity.

Since the fixing roller 59 is heated, the recording paper 39 may stick to the fixing roller 59. Conventionally, a detachment claw is arranged so as to be in contact with the fixing roller 59 to detach the recording paper 39 therefrom. As shown in FIG. 6A, the pressure applying spring 68 presses the fixing roller 59 against the recording paper 39 with a constant pressure. Further, the recording paper 39 is held by the transporting means 38*a* and 38*b*. With the above structure, it is possible to prevent the recording paper 39 from sticking due to the rotating force of the fixing roller 59. Hence, it is not necessary to use the detachment claw, so that the lifetime of the fixing roller 59 can be lengthened.

Figure 12A:
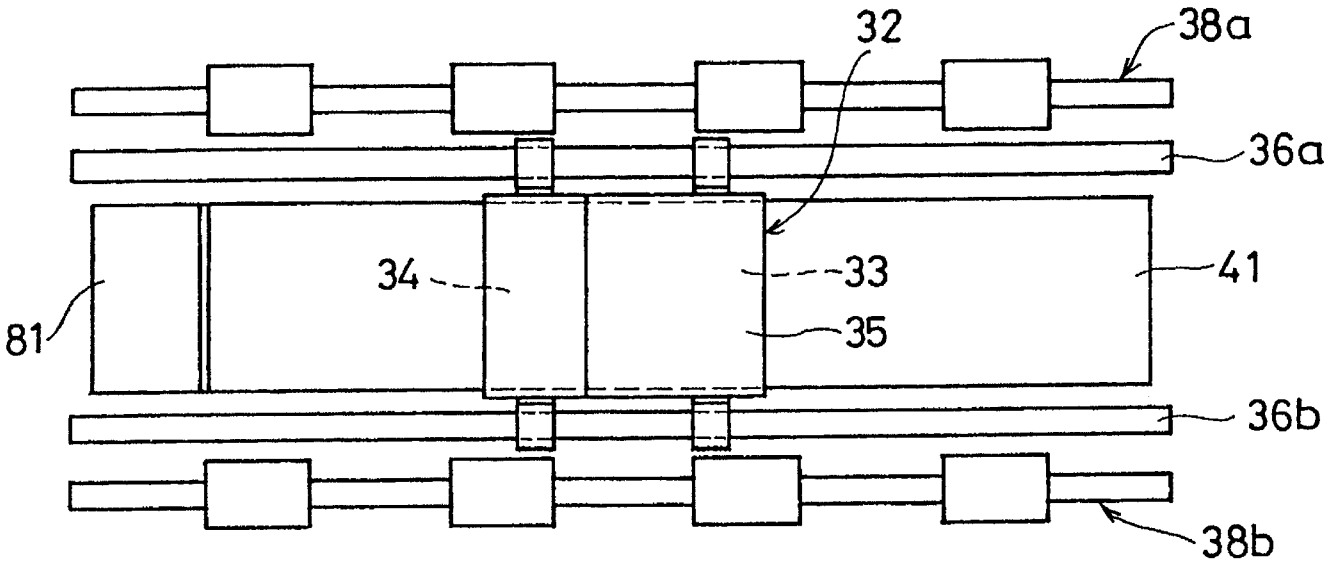
FIG. 12A is a plan view of a second embodiment of the present invention.
Figure 12B:
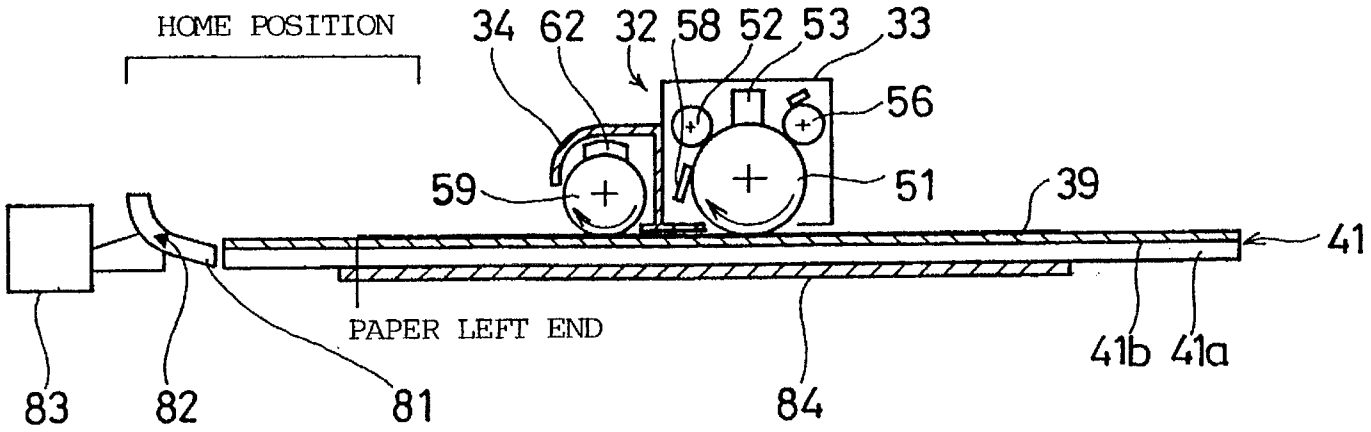
FIG. 12B is a cross-sectional view of the second embodiment of the present invention

A description will now be given, with reference to FIGS. 12A and 12B, of a second embodiment of the present invention. FIG. 12A is a plan view of a carriage and its peripheral parts of an electrophotographic printing machine according to the second embodiment of the present invention. FIG. 12B is a schematic cross-sectional view of a side portion of the structure shown in FIG. 12A. In FIGS. 12A and 12B, parts that are the same as those shown in the previously described figures are given the same reference numbers.

The fixing unit 34 of the carriage shown in FIGS. 12A and 12B has a casing 34*a* in which only the fixing roller 59 and the coating device 62 for coating a silicon oil are provided. Further, the casing 34*a* is formed of a heat-resistant material and is partially opened. A first heating unit 81 is provided at one end of the transfer unit 41, which includes the base 41*a* and the heat-resistant electrically conductive member 41*b*. The first heating unit 81 has an induction heating coil (which does not appear in the figure) having a circular, spiral or coiled shape as shown in FIGS. 7A, 7B and 7C, FIGS. 9A and 9B or FIGS. 10A and 10B.

The first heating unit 81 and a part of the transfer unit 41 in the vicinity of the first heating unit 81 are defined as a home position of the carriage 32. That is, when the carriage 32 is located in the home position, the fixing roller 59 is located above and is in contact with or slightly spaced apart from the first heating unit 81.

The first heating unit 81 is equipped with a thermistor 82. A heating drive controller 83 performs a heating and temperature control on the basis of the temperature sensed by the thermistor 82. The heating drive controller 83 corresponds to the inverter 65 and the main control circuit 66 shown in FIG. 5. A second heating unit 84 for maintaining the temperature of the transfer unit 41 is provided below the transfer unit 41. The second heating unit 84 has almost the same width as that of the recording paper 39. The other parts of the second embodiment of the present invention are the same as those of the first embodiment thereof, and a description thereof will be omitted.

Figures 13A, 13B, 13C:
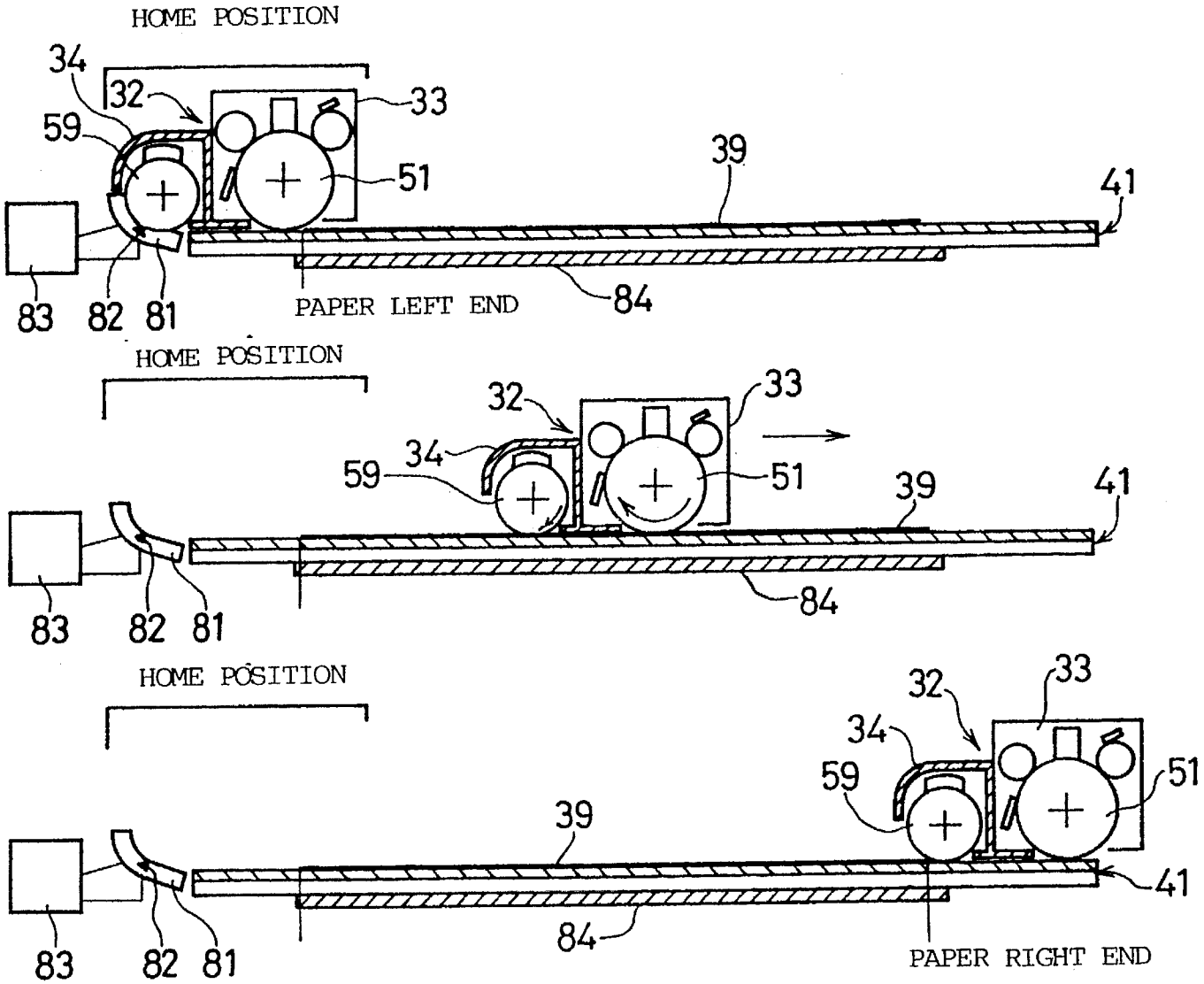
FIGS. 13A, 13B and 13C are diagrams showing the operation of the second embodiment of the present invention.

FIGS. 13A, 13B and 13C are diagrams showing the operation of the electrophotographic printing machine shown in FIGS. 12A and 12B. At the commencement of the printing operation, the carriage 32 is located in the home position, as shown in FIG. 13A. At this time, the fixing roller 59 is positioned above the first heating unit 81, and the fixing roller 59 is induction-heated. The heating driving controller 83 controls the heating on the basis of the temperature sensed by the thermistor 82. The fixing unit 41 is heated by the second heating unit 84.

When the fixing roller 59 is heated to the predetermined temperature (for example, 180° C.), as shown in FIG. 13B the carriage 32 is moved in the direction transverse to the transporting direction of the recording paper 39 and the printing is started. During the time when the carriage is being moved, the heating of the fixing roller 59 is not performed. The second heating unit 84 heats the transfer unit 41 and maintains the temperature thereof in order to decrease the surface temperature of the fixing roller 59 during the movement of the carriage 32.

As shown in FIG. 13C, when the printing of one line is completed, the carriage 32 is returned to the home position as shown in FIG. 13A, and the recording paper is transported by a distance equal to one line. At this time, the fixing roller 59 is heated to the predetermined temperature in the home position.

According to the second embodiment of the present invention, the carriage 32 can be down-sized because the heating means for heating the fixing roller 59 is provided outside of the fixing unit 34. Further, since the first heating unit 81, which needs a high voltage, is made stationary, there is little noise and the possibility that a leak may occur between the cables for power supply can be reduced. Further, it is possible to reduce the possibility of emitting smoke due to abnormal heating of the recording paper 39. Furthermore, it is easy to control the temperature of the fixing roller 59 and it is thus possible to reduce the preheating time.

Figure 14A:
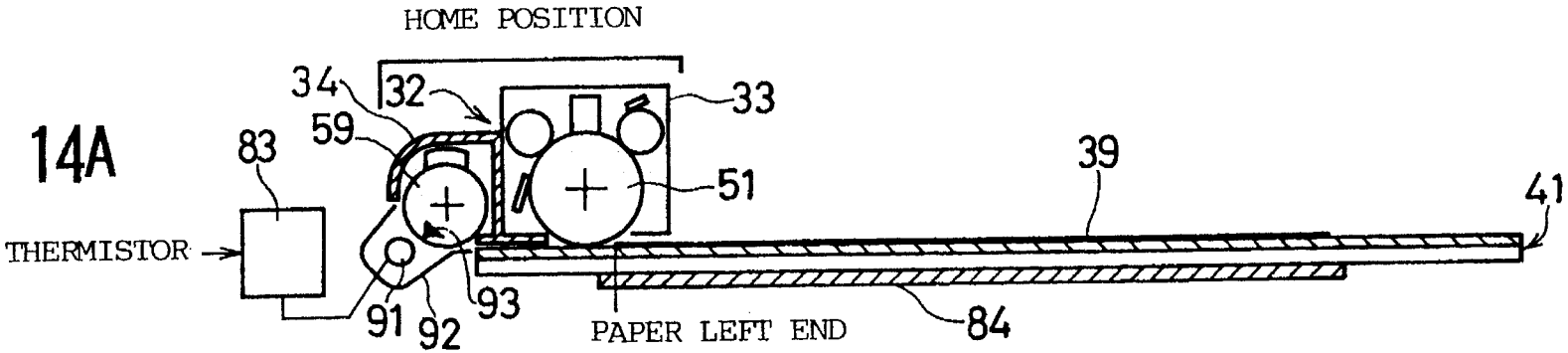
FIGS. 14A, 14B and 14C are diagrams of a variation of the second embodiment of the present invention.
Figure 14B:
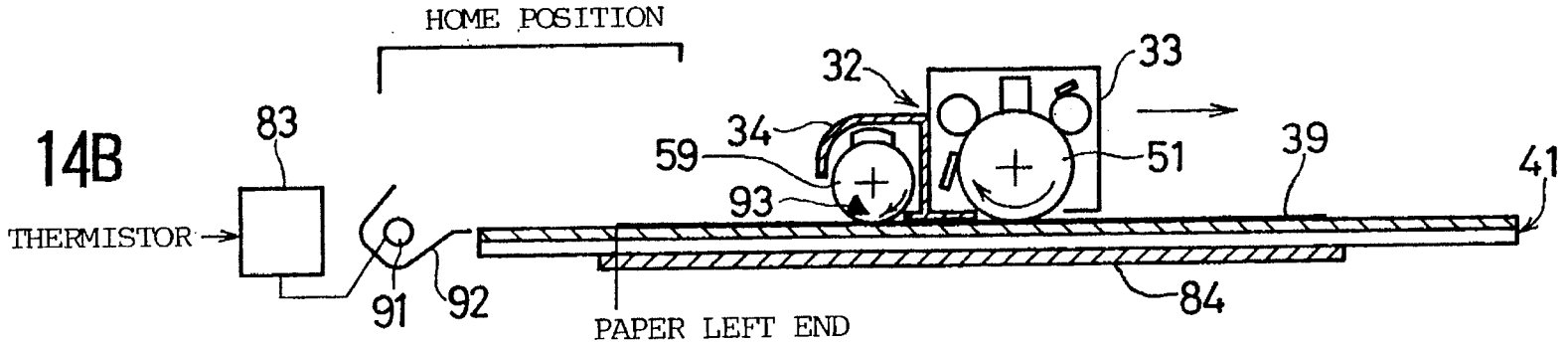
Figure 14C:
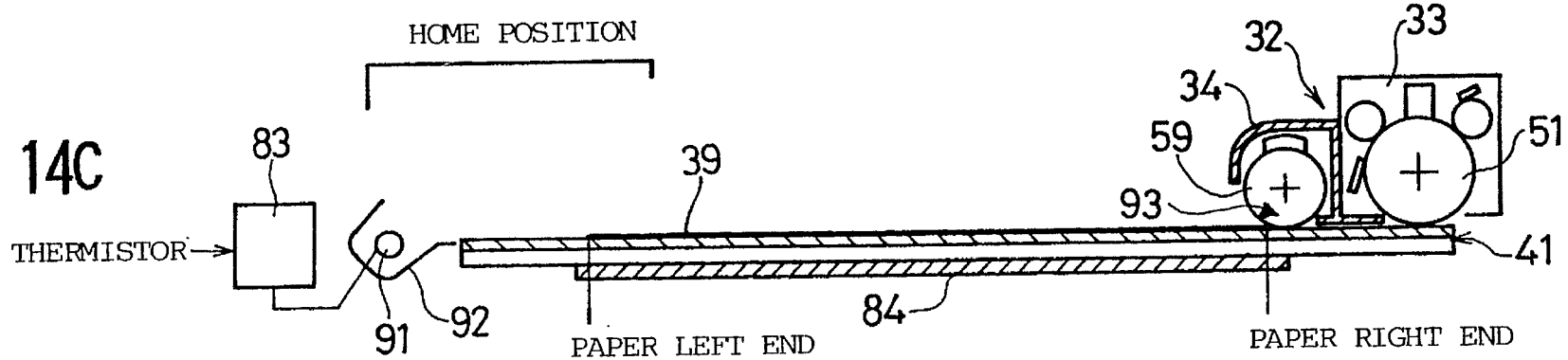

FIGS. 14A, 14B and 14C show a variation of the second embodiment of the present invention. In these figures, parts that are the same as those shown in FIGS. 13A, 13B and 13C are given the same reference numbers, and a description thereof will be omitted. More particularly, FIG. 14A shows the carriage 32 located in the home position, FIG. 14B shows the printing operation being performed, and FIG. 14C shows the printing completed.

The variation shown in FIGS. 14A, 14B and 14C is designed so that a halogen lamp 91 of a self-heating member is provided at one end of the transfer unit 41 and the fixing roller 59 is heated from the outside thereof when the carriage 32 is located in the home position. A reflection member 92 is provided so as to partially surround the halogen lamp 91 in order to efficiently apply the radiated heat to the fixing roller 59. The heating drive controller 83 changes the projection intensity of the halogen lamp 91 on the basis of the temperature sensed by the thermistor 93, so that the temperature of the fixing roller 59 is controlled. The other parts of the variation shown in FIGS. 14A through 14C are the same as those shown in FIGS. 13A through 13C.

When the carriage 32 is located in the home position, the fixing roller 59 is heated to a sufficient temperature by the halogen lamp 91. Then, the printing is started (FIG. 14A). During printing, the temperature of the fixing roller 59 is sensed by the thermistor 93. If the surface temperature of the fixing roller 59 does not become large enough to thermally fix the toner particles on the recording paper 39 thereon before the printing of one line being processed is completed (FIG. 14B), the transfer process and the fixing operation on the line with an insufficient temperature being processed are made to continue (FIG. 14C).

Then, the carriage 32 is moved to the home position, and is heated to the predetermined temperature by the halogen lamp 91. At this time, the line changing operation (transporting the recording paper 39) is not carried out, and only the fixing operation is performed again. Hence, it is possible to prevent degradation of the printing quality due to a decrease in the fixing temperature.

The above operation can be applied to the structure shown in FIGS. 12A and 12B in which the thermistor 82 is provided at the side of the fixing roller 59. By the operation, it is possible to prevent degradation of the printing quality due to a decrease in the fixing temperature in the structure shown in FIGS. 12A and 12B.

The present invention is not limited to the specifically disclosed embodiments, and variations and modifications may be made without departing from the scope of the present invention.

What is claimed is:

1. An electrophotographic printing machine comprising:

transporting means for transporting a recording medium;

a carriage movable in a first direction transverse to a second direction in which the recording medium is transported, said carriage comprising process means for forming a latent image on an image carrier and forming a toner image of the latent image, and fixing means for thermally fixing a transferred image corresponding to the toner image of the latent image on the recording medium;

transfer means, provided at a first side of the recording medium opposite to a second side thereof at which the carriage is located, for transferring the toner image on the recording medium to thereby form said transferred image; and a refuge part located at a side of the transfer means and located in a print starting position in which the fixing means provided in the carriage takes refuge so as to prevent the transfer means from being thermally affected by the fixing means.

2. The electrophotographic printing machine as claimed in claim 1, wherein the refuge part comprises a heat-resistant member which supports the fixing means when the fixing means is located in the refuge part.

3. The electrophotographic printing machine as claimed in claim 2, wherein:

the fixing means comprises a fixing member of a drum shape having a shaft and bearings provided on either side of the shaft;

the heat-resistant member comprises parts which support the bearings when the fixing means is located in the refuge part.

4. The electrophotographic printing machine as claimed in claim 1, wherein the fixing means comprises:

a fixing member; and a pressure applying member which presses the fixing member to the recording medium.

5. The electrophotographic printing machine as claimed in claim 1, wherein the fixing means comprises:

a fixing member containing a magnetic material; and heating means having an induction heating coil member located close to the fixing member, for heating the fixing member by an induction heating process.

6. The electrophotographic printing machine as claimed in claim 5, wherein said induction heating coil member comprises one or a plurality of coils facing the fixing member.

7. The electrophotographic printing machine as claimed in claim 5, wherein:

said induction heating coil member comprises one or a plurality of coils facing the fixing member; and said one or the plurality of coils have spaces located at the center thereof.

8. The electrophotographic printing machine as claimed in claim 6, wherein:

said heating means has a drum shape; and said one or the plurality of coils are stacked stepwise so as to match the drum shape of the heating means.

9. The electrophotographic printing machine as claimed in claim 7, wherein:

said heating means has a drum shape; and said one or the plurality of coils are stacked stepwise so as to match the drum shape of the heating means.

10. The electrophotographic printing machine as claimed in claim 1, further comprising heating control means for controlling the temperature of the fixing means.

11. The electrophotographic printing machine as claimed in claim 10, wherein said heating control means comprises a temperature sensor sensing the temperature of said fixing means.

12. The electrophotographic printing machine as claimed in claim 5, further comprising:

a temperature sensor sensing the temperature of the fixing member; and heating control means for controlling said induction heating coil member on the basis of the temperature of the fixing member sensed by the temperature sensor.

13. The electrophotographic printing machine as claimed in claim 1, wherein said fixing means does not overlap the transfer means when the fixing means is located in the refuge part.

14. The electrophotographic printing machine as claimed in claim 1, wherein said transfer means comprises an electrically conductive member of a sheet shape.

15. An electrophotographic printing machine comprising:

transporting means for transporting a recording medium;

a carriage movable in a first direction transverse to a second direction in which the recording medium is transported, said carriage comprising process means for forming a latent image on an image carrier and forming a toner image of said latent image, and fixing means having a fixing member for thermally fixing a transferred image corresponding to the toner image on the recording medium;

transfer means, provided at a first side of the recording medium opposite to a second side thereof at which the carriage is located, for transferring the toner image on the recording medium to thereby form said transferred image;

a refuge part located at a side of the transfer means and located in a print starting position in which the fixing means provided in the carriage takes refuge so as to prevent the transfer means from being thermally affected by the fixing means; and heating means for heating the fixing member of said fixing means when the carriage is located in the print starting position.

16. The electrophotographic printing machine as claimed in claim 15, wherein said heating means is located so as to be in contact with the fixing member when the carriage is located in the print starting position.

17. The electrophotographic printing machine as claimed in claim 15, wherein said heating means is located so as to be spaced apart from the fixing member by a predetermined distance when the carriage is located in the print starting position.

18. The electrophotographic printing machine as claimed in claim 15, wherein the refuge part comprises a heat-resistant member which supports the fixing means when the fixing means is located in the refuge part.

19. The electrophotographic printing machine as claimed in claim 18, wherein:

the fixing means comprises a fixing member of a drum shape having a shaft and bearings provided on either side of the shaft;

the heat-resistant member comprises parts which support the bearings when the fixing means is located in the refuge part.

20. The electrophotographic printing machine as claimed in claim 15, wherein:

the fixing member comprises a magnetic material; and said heating means comprises an induction heating coil member heating the fixing member of the fixing means by an induction heating process.

21. The electrophotographic printing machine as claimed in claim 15, wherein said heating means comprises a self-heating member heating the fixing member of the fixing means.

22. The electrophotographic printing machine as claimed in claim 15, further comprising heating drive means for controlling the temperature of the heating means to heat the fixing member.

23. The electrophotographic printing machine as claimed in claim 15, further comprising:

a temperature sensor sensing the temperature of the fixing member of the fixing means; and heating drive means for controlling the temperature of the heating means on the basis of the temperature sensed by the temperature sensor, so that the temperature of the fixing member is controlled.

24. The electrophotographic printing machine as claimed in claim 15, further comprising second heating means, provided in the transfer means, for maintaining the temperature of the fixing member of the fixing means.

25. The electrophotographic printing machine as claimed in claim 15, wherein:

the fixing means comprises a casing in which the fixing member is provided; and the casing comprises a heat-resistant member.

* * * * *